United States Patent [19]

Sigler

[11] Patent Number: 4,588,449

[45] Date of Patent: May 13, 1986

[54] OXIDE WHISKER GROWTH ON CONTAMINATED ALUMINUM-CONTAINING STAINLESS STEEL FOIL

[75] Inventor: David R. Sigler, Sterling Heights, Mich.

[73] Assignee: General Motors Corporation, Detroit, Mich.

[21] Appl. No.: 677,285

[22] Filed: Dec. 3, 1984

[51] Int. Cl.[4] ..... C23C 11/10; C23C 11/11; C23C 8/06

[52] U.S. Cl. ..... 148/6.35; 148/6.3

[58] Field of Search ..... 148/6.35, 6.3

[56] References Cited

U.S. PATENT DOCUMENTS 4,318,828 3/1982 Chapman ..... 148/6.35 X
4,331,631 5/1982 Chapman et al. ..... 148/6.3 X

OTHER PUBLICATIONS

Golightly et al., "The Influence of Yttrium Additions on the Oxide-Scale Adhesion to an Iron-Chromium-Aluminum Alloy" Oxidation of Metals, vol. 10, No. 3, 1976, pp. 163-187.

Golightly et al., "The Early Stages of Development of Alpha-$Al_2O_3$ Scales on Fe-Cr-Al and Fe-Cr-Al-Y Alloys at High Temperature", Oxidation of Metals, vol. 14, No. 3, 1980, pp. 217-234.

American Society for Metals, Heat Treating, Metals Handbook, 9th Edition, vol. 4, pp. 307-311.

*Primary Examiner*—James R. Hoffman
*Attorney, Agent, or Firm*—Douglas D. Fekete

[57] ABSTRACT

In aluminum-containing stainless steel foil, the presence of magnesium impurity in an amount greater than about 0.002 weight percent has been found to inhibit formation of a preferred oxide surface layer characterized by multitudinous oxide whiskers of a type suitable for tightly bonding an applied coating. A method for purifying magnesium-contaminated foil comprises heating the foil to selectively vaporize the magnesium while avoiding incipient melting of the base alloy, preferably between about 1000° C. and 1150° C. The magnesium vapors escape into a suitable ambient phase such as a vacuum or a dry hydrogen gas. Thereafter, the foil is oxidized under conditions effective to produce the desired whiskers. A preferred steel is composed of an iron-base alloy comprising about 15 to 25 weight percent chromium and 3 to 6 weight percent aluminum, and optionally may contain cerium or yttrium in an amount effective to promote oxide adherence.

6 Claims, 3 Drawing Figures

OXIDE WHISKER GROWTH ON CONTAMINATED ALUMINUM-CONTAINING STAINLESS STEEL FOIL

BACKGROUND OF THE INVENTION

This invention relates to oxidation of iron-chromium-aluminum alloy foil to form thereon an oxide layer characterized by multitudinous whiskers. More particularly, this invention relates to a preparatory purification-treatment for foil composed of contaminated alloy to allow subsequent growth of the whiskers.

Aluminum-containing ferritic stainless steel has properties including corrosion resistance that render it particularly useful for high temperature applications, for example, as a substrate in an automotive catalytic converter. A typical steel comprises 15 to 25 weight percent chromium, 3 to 6 weight percent aluminum and the balance mainly iron. When exposed to oxygen at elevated temperatures, this iron-chromium-aluminum alloy forms a surface alumina layer that protects the underlying metal against further corrosion. The alloy may contain a small amount of an agent such as yttrium or cerium that promotes adherence of the oxide to the metal and thereby further improves high temperature corrosion resistance.

The surface of the protective oxide layer typically formed on iron-chromium-aluminum alloy is relatively smooth. However, under certain conditions, an oxide layer is formed that is characterized by multitudinous whiskers. The whiskers substantially improve bonding of an applied coating. U.S. Pat. No. 4,331,631, issued to Chapman et al in 1982, describes growth of the whiskers on foil formed by a metal peeling process. U.S. Pat. No. 4,318,828, issued to Chapman in 1982, describes a two-step oxidation treatment which is particularly useful for growing the whiskers on cold-rolled foil. In the two-step treatment, the foil is initially heated for a brief time on the order of a few seconds in a low oxygen atmosphere to form a precursor oxide film. Thereafter, the whiskers are grown by heating in air for several hours at a suitable temperature.

It has been found that some iron-chromium-aluminum alloy foil does not grow the desired multitudinous whiskers even when oxidized under preferred conditions for doing so. In particular, difficulty has been encountered in growing whiskers on commercial cold-rolled stock prepared from large heats. I have now found that this inability to grow the whiskers is related to magnesium impurity in the metal. In a typical example of contaminated foil, magnesium may be present in an amount on the order of 0.01 weight percent. Magnesium may be introduced in the constituent metals or in an agent for deoxidation or desulfurization. Another potential source is the refractory lining of the crucible or other vessel in which the alloy is melted. This lining is predominantly an inert ceramic such as alumina, but may contain a small amount of magnesium oxide. In preparing a large heat, the metal may reside in contact with the refractory for an extended time, during which magnesium may leech into the melt. In any event, I have found that the presence of magnesium in an amount greater than about 0.002 weight percent noticeably inhibits growth of the desired whiskers.

Therefore, it is an object of this invention to provide a method for treating aluminum-containing stainless steel foil comprising magnesium impurity in an amount sufficient to inhibit oxide whisker formation, which method selectively removes magnesium from the alloy and thereby permits multitudinous whiskers to be subsequently grown thereon. One feature of this invention is that the treatment is carried out on the solid steel to purify the alloy without physically altering the foil or requiring change to processes or equipment for preparing the alloy or manufacturing the foil. Indeed, the method is particularly useful when applied to contaminated foil stock to allow whisker growth on stock that otherwise would not be suitable. Furthermore, the treatment of the iron-chromium-aluminum alloy, which alloy may optionally contain an oxide adherence agent such as yttrium or cerium, removes unwanted magnesium without altering the composition of the base alloy or adversely affecting the desired high temperature properties of the steel.

SUMMARY OF THE INVENTION

In accordance with a preferred embodiment of this invention, magnesium-contaminated iron-chromium-aluminum alloy foil is heat treated to selectively vaporize magnesium from the solid base alloy prior to oxidizing the foil to grow whiskers thereon. The foil is heated at an elevated temperature to cause magnesium to diffuse to the foil surface and sublime, but without incipient melting of the alloy. The magnesium vapors escape into a suitable ambient vapor phase, such as a vacuum or a dry hydrogen gas. Thereafter, the purified foil is oxidized under appropriate conditions to form multitudinous whiskers that substantially cover the foil surface.

The method of this invention is particularly useful for treating contaminated foil, which may contain about 0.01 weight percent magnesium, to reduce the magnesium content preferably to below about 0.002 weight percent. It is not considered sufficient to purify only the foil surface, since the prolonged oxidation step required to grow the desired whiskers permits internal magnesium to diffuse to the surface and frustrate whisker growth. Thus, the treatment purifies inner regions of the foil as well as the surface, which necessitates that magnesium diffuse from the inner regions to the surface for removal. Although magnesium readily sublimes at the surface, diffusion through the solid alloy is a relatively slow process. Higher temperatures accelerate this diffusion and are desired to reduce the treatment time. However, the temperature is not so high that incipient melting occurs and is preferably low enough to permit the foil to be conveniently handled. In general, contaminated foil may be suitably treated by heating at a temperature between 1000° C. and 1150° C. Although the time required to treat the foil depends upon the initial magnesium content and the foil thickness, as well as the specific temperature, contaminated foil may typically be treated at a temperature in the preferred range within a practical time, preferably between about 5 and 60 minutes.

The purification treatment of this invention permits the desired whisker oxide to be formed on foil that would not otherwise be suitable for applications requiring the whiskers to improve bonding of an applied coating. The treatment removes unwanted magnesium, but does not vaporize appreciable amounts of iron, chromium or aluminum. Neither does the treatment extract yttrium or cerium, which are preferred additives for this type of steel. Thus, the treatment of this invention purifies the contaminated alloy without significantly affecting the principal constituents. Furthermore, the treatment is carried out on the solid foil after its manufacture and without physically altering the foil.

DESCRIPTION OF THE DRAWINGS

This invention will be further illustrated by reference to the following figures.

DETAILED DESCRIPTION OF THE INVENTION

The method of this invention was demonstrated by treating commercially obtained, cold-rolled iron-chromium-aluminum-cerium alloy foil. The foil was 0.05 millimeter thick. As received, the alloy was composed of, by weight, about 19.8% chromium, about 5.2% aluminum, about 0.022% cerium, about 0.009% lanthanum, about 0.011% magnesium and the balance iron and innocuous impurities. Cerium and lanthanum are agents that enhance high temperature corrosion resistance. Magnesium was present as an impurity.

The foil was cut into sample panels. Mill oil was removed by ultrasonically cleaning the panels immersed in an aqeuous, mild alkaline detergent solution at ambient temperature. Thereafter, panels were rinsed by immersing and ultrasonically vibrating first in tap water and then in acetone. Panels were dried using hot forced air.

This invention is better understood by comparison to attempts to grow the desired oxide whiskers on the magnesium-contaminated foil without a purification pretreatment. Acccordingly, a cleaned panel was subjected to a preferred two-step oxidation treatment for growing whiskers on foil of this type. The panel was heated for 10 seconds at 900° C. while exposed to an atmosphere formed of high purity dry carbon dioxide atmosphere. The carbon dioxide dissociates at the elevated temperature to provide a trace amount of oxygen sufficient to oxidize the surface to form thereon a suitable precursor oxide film. Thereafter, the panel was cooled and reheated at 925° C. for 16 hours while exposed to air. Additional information regarding this two-step treatment for growing oxide whiskers on cold-rolled foil is provided in U.S. Pat. No. 4,318,828, incorporated herein by reference.

Figure 1:
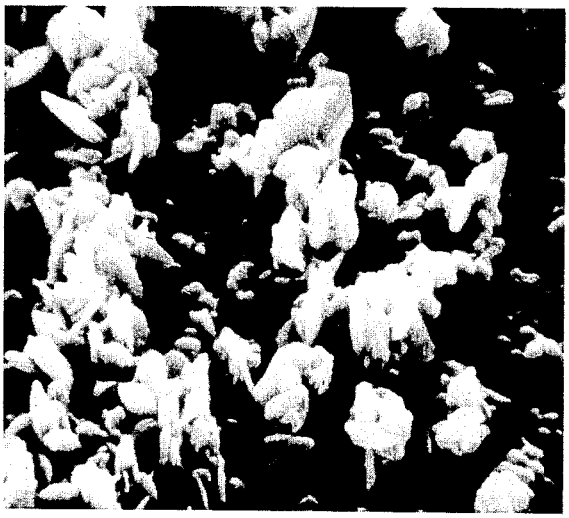
FIG. 1 is a scanning electron photomicrograph showing, at 10,000X magnification, a non-whisker oxidized surface of a foil composed of magnesium-contaminated iron-chromium-aluminum alloy.

FIG. 1 shows a portion of the resulting oxidized surface of the magnesium-contaminated foil examined using a scanning electron microscope. Although the oxide surface appears irregular because of the high magnification, the surface is mainly covered by nodular formations. Only occasional whiskers are observed. It has been found that a coating, such as a ceramic wash-coat, applied to a nodular oxide as shown in FIG. 1 does not tightly adhere to the foil, but rather tends to spall.

A second panel was treated in accordance with this invention prior to successfully growing the desired oxide whiskers thereon. The cleaned panel was heated at about 1000° C. for about two hours within a vacuum furnace evacuated to approximately 0.01 Pascals, in a manner similar to vacuum annealing. Following this vacuum heat treatment, the metal was analyzed. It was found that the proportions of the principal metals including chromium, aluminum, cerium and lanthanum, remained substantially constant, but that the concentration of magnesium had been reduced to below 0.002 weight percent.

Figure 2:
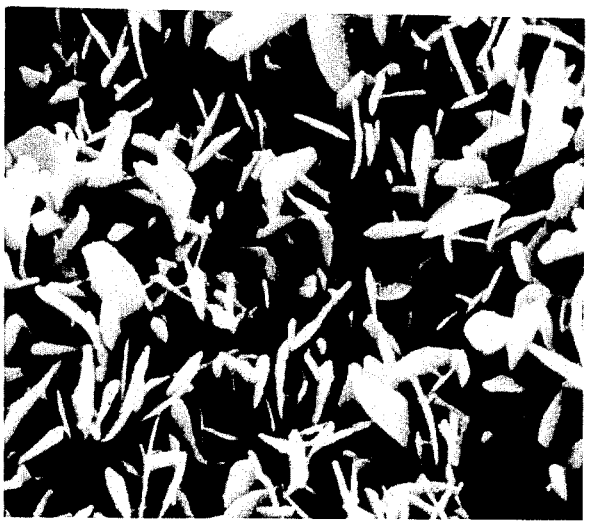
FIG. 2 is a scanning electron photomicrograph showing, at 10,000X magnification, multitudinous oxide whiskers formed on the surface of foil similar to the foil in FIG. 1, but subjected to a vacuum purification treatment in accordance with a first embodiment of this invention prior to oxidizing the foil to grow the whiskers thereon.

The panel was then oxidized in accordance with the described two-step procedure used for the panel in FIG. 1; that is, 10 seconds in carbon dioxide at 900° C., followed by 16 hours in air at 925° C. FIG. 2 shows a portion of the product oxidized surface viewed with the aid of a scanning electron microscope. As can be seen in the figure, oxidation of the purified foil produced multitudinous whiskers that substantially cover the foil surface. The whiskers comprise long, thin, protruding crystals and are preferred for penetrating and tightly bonding an applied coating.

Figure 3:
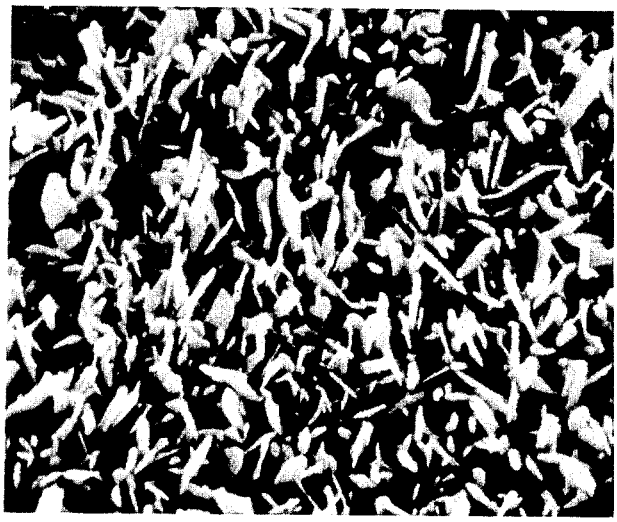
FIG. 3 is a scanning electron photomicrograph showing, at 10,000X magnification, oxide whiskers formed on a surface of foil similar to the foil in FIG. 1, but subjected to a hydrogen purification treatment in accordance with an alternate embodiment of this invention prior to oxidizing the foil to grow the whiskers thereon.

In an alternate embodiment of this invention, another cleaned panel of the magnesium-contaminated alloy was treated while exposed to a dry hydrogen atmosphere prior to successfully growing whiskers thereon. The panel was heated at about 1100° C. for about 10 minutes. The dew point of the hydrogen atmosphere was between about −60° C. and −30° C. The gas was near atmospheric pressure. Thereafter, the panel was subjected to the preferred two-step procedure for growing whiskers, under conditions essentially identical to those for the panels in FIGS. 1 and 2. FIG. 3 shows a portion of the oxidized surface viewed with a scanning electron microscope. As can be seen, the surface is substantially covered by oxide whiskers. In comparison to the whiskers shown in FIG. 2, this higher temperature, hydrogen treatment increased the number of whiskers per area, but produced generally smaller crystals. Although not as preferred as the large whiskers in FIG. 2, the whisker topography in FIG. 3 is suitable to improve adhesion of an applied coating, particularly in comparison to the oxide in FIG. 1.

Thus, the method of this invention grows multitudinous whiskers on foil formed of contaminated alloy that would otherwise produce, at most, only occasional whiskers. The whiskered layer, which is principally composed of alumina, substantially covers the foil and protects the underlying metal against further oxidation. While not limited to any particular theory, whisker growth is believed to result from aluminum migration through defects in the oxide film that initially forms on the alloy. Aluminum migrates from the underlying metal and erupts at the oxide surface to cause the alumina crystal to grow into the desired whisker. In contaminated alloy, magnesium apparently infiltrates the defects and blocks further aluminum migration, so that alumina crystals forming on the surface do not mature into whiskers. However, the method of this invention removes magnesium from the alloy and thereby permits the alumina crystals to mature.

This invention is applicable to stainless steel foil principally formed of iron, chromium and aluminum. A preferred steel for a catalytic converter comprises 15 to 25 weight percent chromium, 3 to 6 weight percent aluminum, and the balance mainly iron. In the described examples, the alloy also contains a small addition of cerium and lanthanum to promote oxide adherence. A preferred cerium content is between about 0.002 and 0.05 weight percent. Although this effect is principally attributed to cerium, cerium is typically added as mischmetal that contains lanthanum, which may also enhance oxide adherence. Yttrium also promotes oxide adherence and may be added instead of cerium, preferably in an amount between about 0.3 and 1.0 weight percent. Further, the alloy may contain zirconium or other suitable agents to desirably influence metallurgical properties. For this type of steel, magnesium is not generally added intentionally or considered to enhance any particular metallurgical properties, but rather is present as an impurity or residual. However, it has been found that magnesium has such a profound effect upon whisker formation that even a small quantity of this impurity substantially inhibits whisker growth. It is recognized that not all iron-chromium-aluminum alloy is contaminated by magnesium in an amount sufficient to inhibit whisker growth. For contaminated alloy, the magnesium concentration is generally less than 0.02 percent, which is suitably reduced by the treatment of this invention to below 0.002 weight percent, that is, to a level whereat the magnesium does not interfere with whisker growth. The time required to treat the alloy is related to the amount of contamination. In general, it is desired to treat the alloy within a practical time, preferably less than one hour. For alloy containing less than about 0.02 weight percent magnesium, treatment may generally be effectuated within 5 to 60 minutes.

The method of this invention is particularly suited for treating relatively thin alloy, for example, foil not greater than about 0.1 millimeter thick. Because diffusion of magnesium through the solid alloy is a relatively slow process, particularly in comparison to vaporization, the time required to treat the alloy also depends upon the thickness of the alloy. Thicker alloy increases the distance over which magnesium must travel to the surface and thereby extends the time required to remove the magnesium. In general, it has been found that the time required to purify the alloy is related to the square of the thickness of the alloy. Although in the described examples the method was applied to cold-rolled foil, the method is also suitable for treating other types of foil, for example, foil formed by a metal peeling process.

The magnesium diffusion through the solid alloy is also related to the temperature. In general, higher temperatures are desired to accelerate this diffusion. Although magnesium vaporizes at temperatures below 1000° C., the slow diffusion of magnesium at low temperatures substantially prolongs the time required to treat the alloy. For example, alloy that may be suitably treated at 1000° C. for one hour requires approximately six hours at 900° C. Further, in accordance with this invention, the treatment temperature is maintained below the melting point of the base alloy to avoid incipient melting which, if allowed to occur, would affect the physical characteristics of the foil. For the alloy in the described examples, treatment may be suitably carried out at temperatures up to about 1300° C. without damage to the foil. However, as a practical consideration, greater difficulty in handling the foil is encountered at temperatures above about 1150° C. Thus, it is preferred to carry out the treatment at a temperature between about 1000° C. and 1150° C.

The magnesium vapors created by the purification treatment escape into a suitable ambient phase. Suitable phases include a vacuum or a hydrogen atmosphere, as in the described examples, and permit the magnesium to vaporize while avoiding reaction at the alloy surface. Of concern is the presence of oxygen in the ambient phase, since oxygen tends to react with both magnesium and aluminum. The ambient oxygen content is preferably sufficiently low to avoid formation of a substantially continuous alumina film at the alloy surface, which film would form a physical barrier to the escape of the magnesium. However, magnesium vaporization is not significantly deterred by the presence of low amounts of oxygen. Despite the tendency of magnesium to oxidize, ambient oxygen does not apparently interfere with magnesium vaporization. Although the reason for this is not fully understood, it is believed that the oxidation of magnesium may not be thermodynamically favored at the alloy surface because of the dilute magnesium concentration. In any event, the method of this invention may be carried out despite the presence of trace oxygen in the ambient phase.

In the described examples, the whiskers were grown by a two-step oxidation process wherein the purified alloy was exposed in a first step to a carbon dioxide atmosphere. Oxygen formed by dissociation of the carbon dioxide reacts with the foil surface to produce a precursor film for growing the whiskers. Other atmospheres containing reactive oxygen at a partial pressure preferably less than 0.75 torr may be substituted for the carbon dioxide atmosphere. Although in the described examples treatment with a carbon dioxide atmosphere provides a reproducible process for consistently growing whiskers, it is found that a separate low-oxygen step following the purification treatment is not essential to whisker growth. Thus, the purification treatment of this invention may be carried out while exposed to a vapor phase containing a suitably low oxygen content insufficient to form a barrier to magnesium vaporization, but effective to produce a precursor oxide film on the foil surface for growing the whiskers. Thus, in an alternate example, whiskers have been grown on contaminated alloy by carrying out by purification pretreatment while exposed to dry hydrogen atmosphere containing a trace amount of oxygen and directly thereafter oxidizing in air at a suitable temperature to grow the whiskers.

The whiskers are preferably formed by heating the foil while exposed to air, as described in U.S. Pat. Nos. 4,331,631 and 4,318,828. Although the optimum temperature for growing the whiskers depends upon several factors including the specific alloy composition, in general, the whiskers may be grown by heating preferred iron-chromium-aluminum-cerium alloy at a temperature between about 870° C. and 970° C., preferably between 900° C. and 930° C., for a time greater than about 4 hours.

Although this invention has been described in terms of certain embodiments thereof, it is not intended to be limited thereby, but only to the extent set forth in the claims that follow.

The embodiments of the invention in which an exclusive property or privilege is claimed are defined as follows.

1. A method for forming an integral oxide layer characterized by multitudinous oxide whiskers on ferritic stainless steel foil initially being composed of an iron-base alloy containing chromium, aluminum, and magnesium, said magnesium being present as an impurity in an amount sufficient to inhibit formation of said whiskers, said method comprising heating the foil at a temperature effective to selectively vaporize magnesium from the solid alloy while avoiding incipient melting of the alloy, said magnesium diffusing from interior regions of the foil to surfaces thereof and subliming into a suitable ambient phase, said magnesium vaporization continuing for a time sufficient to reduce the magnesium concentration in the alloy to below 0.002 weight percent, and oxidizing the foil to form the oxide whisker layer.

2. A method for forming an integral oxide layer characterized by multitudinous oxide whiskers on aluminum-containing ferritic stainless steel foil, said foil initially being composed of an iron-base alloy containing 15 to 25 weight percent chromium, 3 to 6 weight percent aluminum, and magnesium as an impurity in an amount sufficient to inhibit formation of said whiskers, said method comprising heating the foil at a temperature effective to selectively vaporize magnesium from the solid alloy while avoiding incipient melting of the alloy, said magnesium diffusing from interior regions of the foil to surfaces thereof and subliming into a suitable ambient phase, said magnesium vaporization continuing for a time sufficient to reduce the magnesium concentration in the alloy to below 0.002 weight percent, and oxidizing the foil to form the oxide whisker layer.

3. A method for forming an integral oxide layer on aluminum-containing ferritic stainless steel alloy foil, said oxide layer being characterized by multitudinous oxide whiskers suitable for tightly bonding an applied coating, said foil initially being composed of an iron-base alloy containing 15 to 25 weight percent chromium, 3 to 6 weight percent aluminum, optionally an agent selected from the group consisting of cerium and yttrium in an amount effective to promote oxide adherence, and magnesium impurity in an amount less than about 0.02 weight percent and sufficient to inhibit formation of said whiskers, said method comprising heating the foil at a temperature between about 1000° C. and 1150° C. while exposed to a vacuum to selectively vaporize magnesium from the solid alloy, said magnesium diffusing from interior regions of the foil to surfaces thereof and subliming, said magnesium vaporization continuing for a time sufficient to reduce the magnesium concentration in the alloy below 0.002 weight percent, and oxidizing the foil to form the oxide whisker layer.

4. A method for forming an integral oxide layer on aluminum-containing ferritic stainless steel alloy foil, said oxide layer being characterized by multitudinous oxide whiskers suitable for tightly bonding an applied coating, said foil initially being composed of an iron-base alloy containing 15 to 25 weight percent chromium, 3 to 6 weight percent aluminum, and magnesium impurity in an amount on the order of 0.01 weight percent and sufficient to inhibit formation of said whiskers, said method comprising heating the foil at a temperature between about 1000° C. and 1150° C. while exposed to a vacuum to selectively vaporize magnesium from the solid alloy, said magnesium diffusing from interior regions of the foil to surfaces thereof and subliming, said magnesium vaporization continuing for a time between about 5 and 60 minutes and sufficient to reduce the magnesium concentration in the alloy below 0.002 weight percent, and heating the purified foil while exposed to a carbon dioxide atmosphere at a temperature sufficient to form a suitable precursor film and thereafter while exposed to air at a temperature and for a time sufficient to grow the multitudinous oxide whiskers.

5. A method for forming an integral oxide layer on aluminum-containing ferritic stainless steel alloy foil, said oxide layer being characterized by multitudinous oxide whiskers suitable for tightly bonding an applied coating, said foil initially being composed of an iron-base alloy containing 15 to 25 weight percent chromium, 3 to 6 weight percent aluminum, optionally an agent selected from the group consisting of cerium and yttrium in an amount effective to promote oxide adherence, and magnesium as an impurity in an amount less than about 0.02 weight percent and sufficient to inhibit formation of said whiskers, said method comprising heating the foil at a temperature between about 1000° C. and 1150° C. while exposed to a dry hydrogen atmosphere to selectively vaporize magnesium from the solid alloy, said magnesium diffusing from interior regions of the foil to surfaces thereof and subliming into the hydrogen atmosphere, said magnesium vaporization continuing for a time sufficient to reduce the magnesium concentration in the alloy below 0.002 weight percent, and oxidizing the foil to form the oxide whisker layer.

6. A method for forming an integral oxide layer on aluminum-containing ferritic stainless steel alloy foil, said oxide layer being characterized by multitudinous oxide whiskers suitable for tightly bonding an applied coating, said foil initially being composed of an iron-base alloy containing 15 to 25 weight percent chromium, 3 to 6 weight percent aluminum, and magnesium as an impurity in an amount on the order of 0.01 weight percent and sufficient to inhibit formation of said whiskers, said method comprising heating the foil at a temperature between about 1000° C. and 1150° C. while exposed to a dry hydrogen atmosphere to selectively vaporize magnesium from the solid alloy, said magnesium diffusing from interior regions of the foil to surfaces thereof and subliming into the hydrogen atmosphere, said magnesium vaporization continuing for a time between about 5 and 60 minutes and sufficient to reduce the magnesium concentration in the alloy below 0.002 weight percent, and heating the purified foil while exposed to a carbon dioxide atmosphere at a temperature sufficient to form a suitable precursor film and thereafter while exposed to air at a temperature and for a time sufficient to grow the multitudinous oxide whiskers.

* * * * *